United States Patent [19]

Bouman et al.

[11] 4,380,714

[45] Apr. 19, 1983

[54] HIGH-PRESSURE DISCHARGE LAMP

[75] Inventors: Anton J. Bouman; Eise B. Geertsema, both of Eindhoven, Netherlands

[73] Assignee: U.S. Philips Corporation, New York, N.Y.

[21] Appl. No.: 216,106

[22] Filed: Dec. 15, 1980

[30] Foreign Application Priority Data

Jan. 15, 1980 [NL] Netherlands ..... 8000228

[51] Int. Cl.[3] ..... H01J 19/68

[52] U.S. Cl. ..... 313/549; 313/559

[58] Field of Search ..... 313/73, 174

[56] References Cited

U.S. PATENT DOCUMENTS 4,025,812 3/1977 McVey ..... 313/174
4,195,251 3/1980 Bamberg ..... 315/73
4,203,049 5/1980 Kuus ..... 313/174

FOREIGN PATENT DOCUMENTS 2007424 5/1979 United Kingdom .

*Primary Examiner*—Harold A. Dixon
*Attorney, Agent, or Firm*—Norman N. Spain

[57] ABSTRACT

An oxidation-sensitive element electrically connected in series with the discharge vessel of a high-pressure discharge lamp extinguishes the lamp when the element, upon fracture of the outer envelope of the lamp, is oxidized and prevents damage as a result of emission of UV radiation.

In a high-pressure discharge lamp according to the invention, the oxidation-sensitive element (7) consists of an electric insulator (20) on which two spaced conductors (21, 22) are provided which are interconnected electrically by a vapor-deposited layer (23) of an oxygen-gettering metallic, evaporating getter. Opposite to the insulator (20) is present a holder (8) from which the getter was previously evaporated on to the insulator.

1 Claim, 2 Drawing Figures

HIGH-PRESSURE DISCHARGE LAMP

Figure 1:
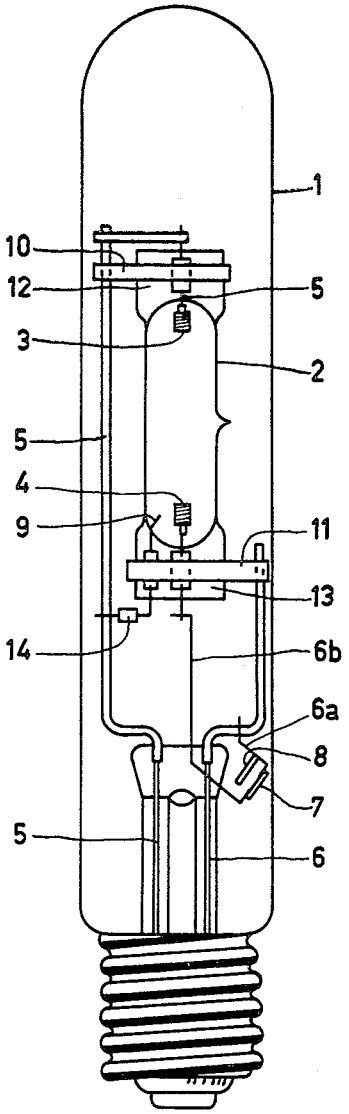

The invention relates to a high-pressure discharge lamp having a vacuum-tight glass outer envelope in which a vacuum-tight, light-transmitting discharge vessel is situated in a non-oxidizing medium and is provided with a pair of electrodes and an ionisable filling, in which lamp current conductors extend through the wall of the outer envelope and the wall of the discharge vessel to the pair of electrodes and in which an oxidation-sensitive element, electrically in series with said current conductors, is situated between the said two walls.

Such a lamp is known from British Pat. No. 2007424. The oxidation-sensitive element in said lamp consists of a foil of molybdenum, tungsten, tantalum, zirconium, or niobium. The object of the element is to prevent, upon fracture of the outer envelope, UV radiation from being emitted for an appreciable period of time. When air penetrates into the outer envelope the foil is oxidized. As a result of this the foil breaks and the lamp is extinguished.

In order to cause that the lamp to be extinguished within a short period of time after fracture of the outer envelope, however, the temperature of the foil should be high. In the known lamp, therefore, the foil is situated in the proximity of an electrode of the discharge vessel. In spite of this, however, the foil still has to be proportioned so that its temperature rises to approximately 700° C. as a result of energy dissipation upon current passage.

It is the object of the invention to provide a high-pressure discharge lamp which is provided with an oxidation-sensitive element which can easily be provided and which, upon fracture of the outer envelope, switches off the lamp in a very short period of time and nevertheless dissipates little or no electric energy during operation of the lamp.

According to the invention, this object is achieved in a high-pressure discharge lamp of the kind mentioned in the opening paragraph by employing an oxidation-sensitive element consisting of an electric insulator on which two spaced conductors are provided and are interconnected electrically by a layer of an oxygen-gettering, metallic, evaporable getter vapour-deposited on said insulator.

Gettering metals which may be used in the lamp according to the invention are known per se and are referred to as evaporable getters. As examples these may be mentioned barium, magnesium, strontium, and calcium. These getters have the favourable properties that, although they react very rapidly with oxygen to form high-ohmic oxides, they can nevertheless easily be handled when present in a holder. They are provided in a holder in a space and, after said space has been sealed, evaporated from the holder, for example, by high-frequency heating. The gettering metal may be present in the holder as such or as an alloy from which the gettering metal is released upon heating. The alloy may be mixed with a metal powder which enters into an exothermal reaction with the alloy and thus accelerates the evaporation of the gettering metal. As examples may be mentioned $BaAl_4$ or $BaAl_4$ mixed with, for example, an equal part by weight of nickel powder, iron powder, titanium powder or thorium powder.

The large affinity of said getters for oxygen gives the lamp designer a large degree of freedom when using the invention with respect to the place where the element which comprises such a getter is situated. Furthermore upon producing the lamp according to the invention no narrow tolerances as regards the positioning of the element need be observed. The temperature which the element assumes during operation is in fact of little influence on the reactivity of the vapour-deposited gettering layer which forms part of the element.

The insulator which forms part of the oxidation-sensitive element may consist of glass or ceramic and may, for example, be a plate. Two conductors are provided on the surface of the insulator. They may each be in the form of a strip, band, or wire which is fixed mechanically to the insulator, for example by clamping. Another possibility is to embed the conductors partly in the insulator. For example, a glass insulator may be provided with two apertures in each of which a conductor is threaded to which the glass of the insulator is then fused. On the other hand, the conductors may be fired to the insulator over a part of their length by softening the insulator and pressing the conductors partly therein so that the conductors are situated at the surface of the insulator. However, the conductors may alternatively consist of a metallic coating which is provided, for example by metal-spraying or vapour deposition. The parts of each one of the current conductors connected to the pair of electrodes of the discharge vessel may be connected to said coating, for example, by welding, soldering or by metal-spraying.

The distance between the conductors on the insulator is not very critical. In practice, a distance of 1 to 2 cm is chosen. The current density in the vapour-deposited metal layer on the insulator during operation of the lamp can be minimized by extending the two conductors parallel to each other on the insulator.

A getter holder with the oxygen gettering, evaporable metallic getter is mounted in the proximity of and facing the two conductors on the insulator. After evacuation of the outer envelope the getter holder is heated, for example at high frequency heating, so as to cause the getter to evaporate and deposit on the insulator and on the conductors provided thereon. If desired the outer envelope may alternatively be filled with an inert gas, for example, a rare gas or a rare gas mixture.

The high-pressure discharge lamp according to the invention may be a high-pressure mercury vapour discharge lamp or such a lamp containing in addition halogen. The lamp may be used for irradiation purposes, for example the irradiation of plants, or for illumination purposes.

As a result of the safety which the lamp has it is particularly suitable for use in open luminaires.

It is to be noted that Russian Pat. No. 267,753 discloses a high-pressure discharge lamp having a cerium foil as an oxidation-sensitive element. However, the patent states that cerium is pyrophoric. This has the disadvantages that safety precautions have to be taken during production of the lamps, that the foil can be exposed to air only restrictedly, that special measures have to be taken when welding the foil to the current conductors, and that it is recommended to provided the foil with a protective coating which, before sealing the outer envelope, has to be removed not only from the foil but also out of the outer envelope.

An embodiment of a high-pressure discharge lamp according to the invention is shown in the drawing. In the drawing FIG. 1 is a side elevation of a lamp according to the invention, FIG. 2 is a perspective view in detail of the oxidation-sensitive element employed in lamp shown in FIG. 1.

In FIG. 1, a discharge vessel 2 of quartz glass in which a pair of electrodes 3, 4 is present is situated in a glass envelope 1. Current conductors 5 and 6, 6*a*, 6*b* extend in a vacuum-tight manner through the wall of the outer envelope 1 and the wall of the discharge vessel 2 to the pair of electrodes 3, 4. The current conductor 6, 6*a*, 6*b* is interrupted so as to incorporate therein an oxidation-sensitive element 7 connected electrically in series with the current conductors 5 and 6, 6*a*, 6*b*. A getter holder 8 is connected to current conductor 6*a*.

An ignition electrode 9 is connected to the current conductor 5 via a resistor 14 having a positive temperature coefficient. Metal bands 10 and 11, which are connected to the current conductors 5 and 6, respectively, are wound around the pinch seals 12 and 13, respectively, of the discharge vessel 2 so as to keep the latter fixed in place.

Figure 2:
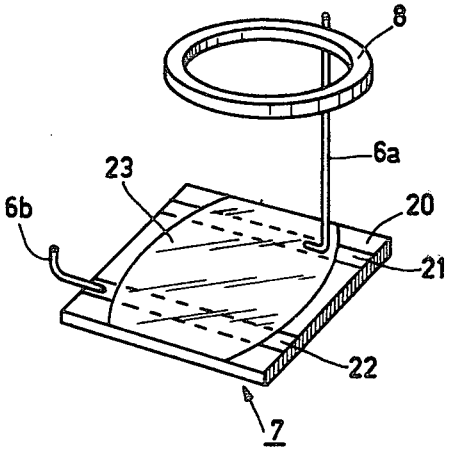

In FIG. 2 an oxidation-sensitive element has an insulator 20 comprising a glass plate which supports two conductors 21 and 22 obtained by metal-spraying the glass plate with copper. Current conductors 6*a* and 6*b*, respectively, are welded to the conductors 21 and 22. A circular metal container 8 of U-shaped cross-section is welded to the current conductor 6*a* with its open side facing the insulator 20. By high-frequency heating of the ring 8, a metallic, oxygen-binding getter was evaporated from the container and there is there was formed on the insulator 20 a metal layer 23 which connects the conductors 21 and 22 electrically together.

EXAMPLE

A high-pressure mercury vapour discharge vessel having an operating power of 125 W at 220 V was situated in an evacuated outer envelope. At one end the outer envelope was extended to form a tube having an inside diameter of 1 cm. In series with the current conductors of the lamp an oxidation-sensitive element was situated between the wall of the discharge vessel and the wall of the outer envelope, which element has been constructed as follows. In an alkali alumino borosilicate glass plate having the dimensions $0.5\times10\times20$ mm two parallel chromium nickel wires were partly sunk in the surface 1 cm apart in such manner that the two wires protruded just above the surface of the glass plate. A gettering ring having a largest diameter of 1 cm and located 2.5 cm from the surface of the glass plate carrying the two embedded wires was filled with equal parts by weight of $BaAl_4$ and Ni powder. 20 mg of barium from the filled gettering ring were vapour-deposited on the insulator and on the two embedded wires after the outer envelope has been sealed.

Twenty minutes after igniting the lamp the tube at the outer envelope was deliberately fractured. The lamp switched off within 3 seconds thereafter as the vapour-deposited metal layer had assumed a very high resistance as a result of oxidation caused by air which had penetrated into the outer envelope.

What is claimed is:

1. A high-pressure discharge lamp having a vacuum-tight glass outer envelope in which a vacuum-tight, light-transmitting discharge vessel is situated in a non-oxidizing medium and is provided with a pair of electrodes and an ionizable filling, in which lamp current conductors extend through the wall of the outer envelope and the wall of the discharge vessel to said pair of electrodes and in which an oxidation-sensitive element is situated between the said two walls, electrically in series with said current conductors, characterized in that the oxidation-sensitive element consists of an electric insulator on which two spaced conductors are provided and are interconnected electrically by a layer of an oxygen gettering metallic evaporable getter vapour-deposited on said insulator.

* * * * *